US010028591B2

(12) United States Patent
Chai

(10) Patent No.: US 10,028,591 B2
(45) Date of Patent: Jul. 24, 2018

(54) STRUCTURE OF INFLATABLE CUSHION

(71) Applicant: Swo-Chung Chai, Taipei (TW)

(72) Inventor: Swo-Chung Chai, Taipei (TW)

( * ) Notice: Subject to any disclaimer, the term of this patent is extended or adjusted under 35 U.S.C. 154(b) by 186 days.

(21) Appl. No.: 15/082,042

(22) Filed: Mar. 28, 2016

(65) Prior Publication Data

US 2017/0273471 A1 Sep. 28, 2017

(51) Int. Cl.

| | |
|---|---|
| ***A47C 27/08*** | (2006.01) |
| ***A47C 27/18*** | (2006.01) |
| ***A47G 9/10*** | (2006.01) |
| ***A47C 7/02*** | (2006.01) |

(52) U.S. Cl.

CPC ..... *A47C 27/081* (2013.01); *A47C 7/021* (2013.01); *A47C 27/08* (2013.01); *A47C 27/087* (2013.01); *A47G 9/1027* (2013.01)

(58) Field of Classification Search

CPC ... A47C 27/081; A47C 27/082; A47C 27/084; A47C 27/087; A47C 7/021; A47C 4/54; A47G 9/1027; B63B 7/08

See application file for complete search history.

(56) References Cited

U.S. PATENT DOCUMENTS 1,335,961 A * 4/1920 Garner ..... A47C 27/081 5/712
1,706,560 A * 3/1929 Carlson ..... A47C 27/081 5/712
1,970,502 A * 8/1934 Hamza ..... A47C 27/081 5/712
2,016,054 A * 10/1935 Sentell ..... A47C 27/081 5/712
2,604,641 A * 7/1952 Reed ..... A47C 27/081 5/710
2,887,692 A * 5/1959 Gosman ..... A47C 27/081 297/DIG. 3
4,823,417 A * 4/1989 Fukuichi ..... A47C 27/081 156/73.1
5,711,041 A * 1/1998 Chen ..... A47C 27/081 5/708
7,234,184 B2 * 6/2007 Yang ..... A47C 27/081 5/644
7,694,372 B1 * 4/2010 Boyd ..... A47C 27/087 5/711
8,146,184 B2 * 4/2012 Lin ..... A47C 27/081 5/417

(Continued)

*Primary Examiner* — Nicholas F Polito
*Assistant Examiner* — Rahib T Zaman
(74) *Attorney, Agent, or Firm* — Rosenberg, Klein & Lee

(57) ABSTRACT

An improved structure of an inflatable cushion includes: a top layer constituting a surface of the inflatable cushion, a bottom layer constituting an undersurface of the inflatable cushion, and a side layer constituting a circumference of the inflatable cushion such that the inflatable cushion defines an interior space. Longitudinal stretch bands and lateral stretch bands are arranged in the interior space in such a way that portions of the longitudinal stretch bands are jointed to the top layer to form first connection sections and portions of the lateral stretch bands are jointed to the bottom layer to form second connection sections. The lateral stretch bands and the longitudinal stretch bands intersect each other and the first connection sections and the second connection sections oppose each other in a vertical direction.

16 Claims, 6 Drawing Sheets

(56) References Cited

U.S. PATENT DOCUMENTS

| | | | | |
|---|---|---|---|---|
| 2012/0000017 | A1* | 1/2012 | Xia | A47C 27/081 5/706 |
| 2013/0145560 | A1* | 6/2013 | Chen | A47C 27/082 5/711 |

* cited by examiner

200

STRUCTURE OF INFLATABLE CUSHION

FIELD OF THE INVENTION

The present invention relates to an improved structure of an inflatable cushion structure, and in particular to an inflatable cushion that comprises longitudinal stretch bands and the lateral stretch bands that arranged in an interior space of the cushion to overlap and intersect each other so as to help spread out and distribute tensile or stretching forces applied to first connection sections with which the bands are jointed to an upper layer of material and second connection sections with which the bands are jointed to a lower layer of material.

BACKGROUND OF THE INVENTION

An inflatable cushion shows the characteristics of comfortableness, softness, and warm-keeping and is thus prevailing among the general consumers. The conventional inflatable cushions are generally formed of an inflatable air sack and an air valve is mounted to a side of the inflatable cushion for inflating the interior of the inflatable cushion thereby expanding the inflatable cushion to for a seat cushion or a bed mattress, allowing a user to sit or lie thereon. Or, the user may open the air valve to release air from the air cushion for reducing the size of the cushion to facilitate convenience of carrying.

The conventional inflatable cushion that involves inflatable air sacks comprises a plurality of connection members in the form of a strip-like, board-like, or cylindrical structure and connected to connect a top surface and an undersurface to each other, allowing the inflatable cushion to demonstrate a desired shape after inflation and also help improve the structural strength of the inflatable cushion. However, when the connection members are broken or detached from the top surface or the undersurface, the connection members lose their functionality, and deformation of the inflatable cushion may result, causing undesired shortening of the lifespan.

Thus, in view of the above-discussed drawbacks, further improvements are necessary.

SUMMARY OF THE INVENTION

The primary object of the present invention is to provide an improved structure of an inflatable cushion, which comprises longitudinal stretch bands and the lateral stretch bands that arranged in an interior space of the cushion to overlap and intersect each other so as to help spread out and distribute tensile or stretching forces applied to first connection sections with which the bands are jointed to an upper layer of material and second connection sections with which the bands are jointed to a lower layer of material, wherein the longitudinal stretch bands and the lateral stretch bands are made of materials having better stretchability so that the potential risk that the first connection sections and the second connection sections are torn apart or broken or otherwise damaged due to stretching or pulling can be reduced.

To achieve the above object, the present invention provides an improved structure of an inflatable cushion, which comprises: a top layer, which constitutes a surface of the inflatable cushion; a bottom layer, which constitutes an undersurface of the inflatable cushion; a side layer, is connected to circumferences of the top layer and the bottom layer to constitute a circumferential surface of the inflatable cushion such that the inflatable cushion defines therein an interior space; a plurality of longitudinal stretch bands, which is arranged in the interior space in such a way that portions of the longitudinal stretch bands are jointed to the top layer to form a plurality of first connection sections; and a plurality of lateral stretch bands, which is arranged in the interior space in such a way that portions of the lateral stretch bands are jointed to the bottom layer to form a plurality of second connection sections, wherein the lateral stretch bands and the longitudinal stretch bands are arranged to overlap and intersect each other and the first connection sections mounted to the top layer and the second connection sections mounted to the bottom layer oppose each other in a vertical direction.

Further, to achieve the above object, the present invention provides another improved structure of an inflatable cushion, which comprises: a top layer, which constitutes a surface of the inflatable cushion; a bottom layer, which constitutes an undersurface of the inflatable cushion and in connected, circumferentially, to an outer circumference of the top layer such that the inflatable cushion defines therein an interior space; a plurality of longitudinal stretch bands, which is arranged in the interior space in such a way that portions of the longitudinal stretch bands are jointed to the top layer to form a plurality of first connection sections; and a plurality of lateral stretch bands, which is arranged in the interior space in such a way that portions of the lateral stretch bands are jointed to the bottom layer to form a plurality of second connection sections, wherein the lateral stretch bands and the longitudinal stretch bands are arranged to overlap and intersect each other and the first connection sections mounted to the top layer and the second connection sections mounted to the bottom layer oppose each other in a vertical direction.

In the above improved structure of an inflatable cushion, the portions of the longitudinal stretch bands are jointed to the top layer by means of ultrasonic fusion to form the first connection sections and the portions of the lateral stretch bands are jointed to the bottom layer by means of ultrasonic fusion to form the second connection sections.

In the above-mentioned improved structure of an inflatable cushion, the top layer, the bottom layer, and the side layer are made of polyvinyl chloride (PVC) or thermoplastic polyurethane (TPU).

In the above-mentioned improved structure of an inflatable cushion, the side layer is provided with an air valve for inflation or deflation of the interior space.

In the above-mentioned improved structure of an inflatable cushion, the inflatable cushion is in the form of a seat cushion, a bed mattress, or a pillow cushion.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
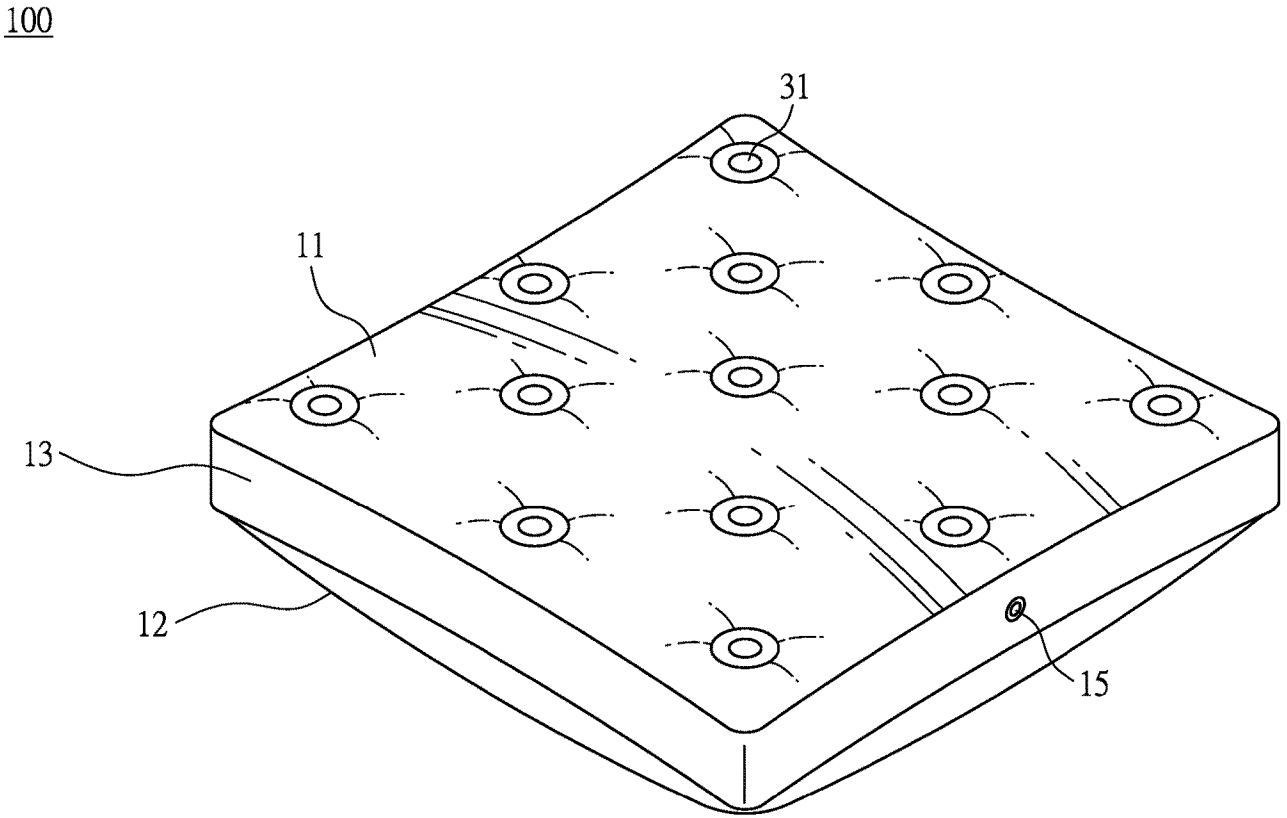
FIG. 1 is a perspective view showing an improved structure of an inflatable cushion according to the present invention.
Figure 2:
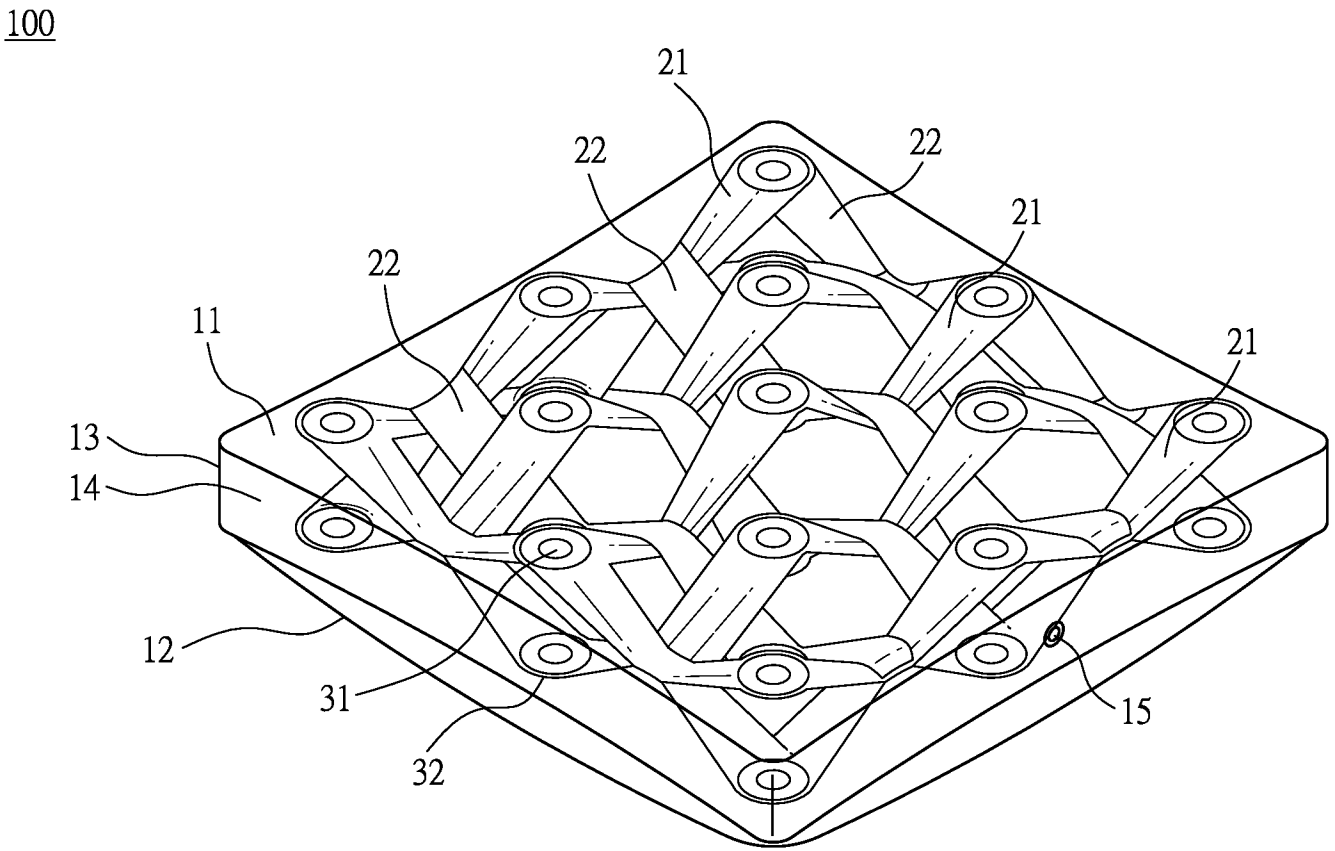
FIG. 2 is a perspective view, in the form of a see-through view, illustrating the improved structure of the inflatable cushion according to the present invention.
Figure 3:
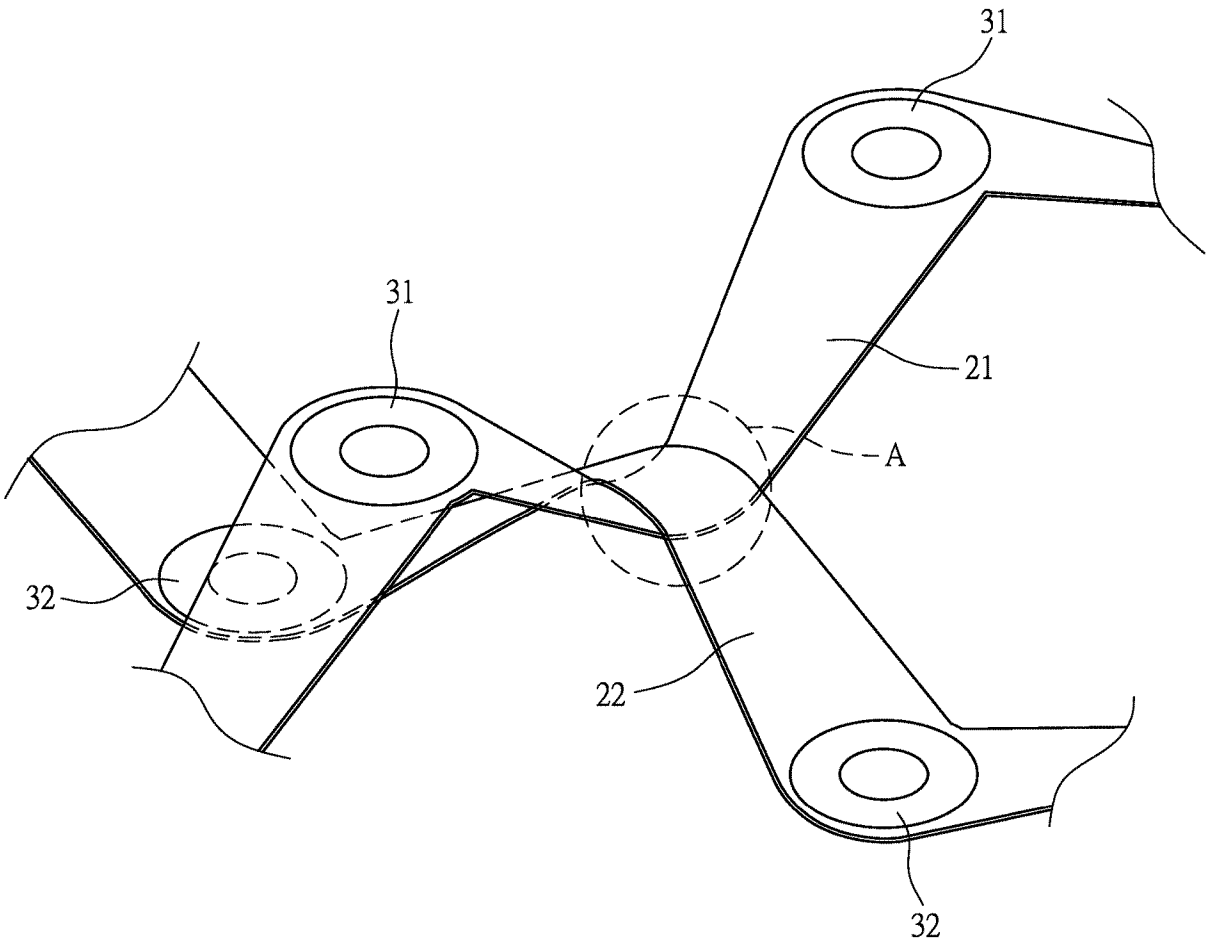
FIG. 3 is an enlarged view of a portion of the improved structure of the inflatable cushion according to the present invention.

Referring to FIGS. 1-3, the present invention provides an improved structure of an inflatable cushion structure, generally designated at 100, comprising: a top layer 11, which constitutes a surface of the inflatable cushion; a bottom layer 12, which constitutes an undersurface of the inflatable cushion; a side layer 13, which is connected to circumferences of the top layer 11 and the bottom layer 12 to constitute a circumferential surface of the inflatable cushion such that the inflatable cushion defines therein an interior space 14; a plurality of longitudinal stretch bands 21, which is arranged in the interior space 14 in such a way that portions of the longitudinal stretch bands 21 are jointed to the top layer 11 to form a plurality of first connection sections 31; and a plurality of lateral stretch bands 22, which is arranged in the interior space 14 in such a way that portions of the lateral stretch bands 22 are jointed to the bottom layer 12 to form a plurality of second connection sections 32, wherein the lateral stretch bands 22 and the longitudinal stretch bands 21 are arranged to overlap and intersect each other and the first connection sections 31 mounted to the top layer 11 and the second connection sections 32 mounted to the bottom layer 12 oppose each other in a vertical direction. One of the top layer 11, the bottom layer 12, or the side layer 13 is provided with an air valve 15 for filling air into or releasing air from the interior space 14 for inflation or deflection.

FIG. 3 is an enlarged view of a portion of the present invention. The improved structure of the inflatable cushion 100 according to the present invention involves a unique intersecting and overlapping arrangement between the longitudinal stretch bands 21 and the lateral stretch bands 22 to help spread out the tensile or stretching force induced in the first connection sections 31 and the second connection sections 32 thereby reducing the potential risk that the first connection sections 31 and the second connection sections 32 are torn a part or broken due to stretching or pulling. Particularly, portions of the longitudinal stretch bands 21 and the lateral stretch bands 22 other than those mounted to the first connection sections 31 and the second connection sections 32 overlap and intersect each other to form overlapping and intersecting sites A. With such an overlapping and intersecting arrangement, when the inflatable cushion is completely filled up with air and thus inflated, the longitudinal stretch bands 21 and the lateral stretch bands 22 may stretch and support each other so as to spread out the tensile or stretching or pulling force applied to the first connection sections 31 and the second connection sections 32 thereby helping enhance the structural strength of the inflatable cushion.

Figure 4:
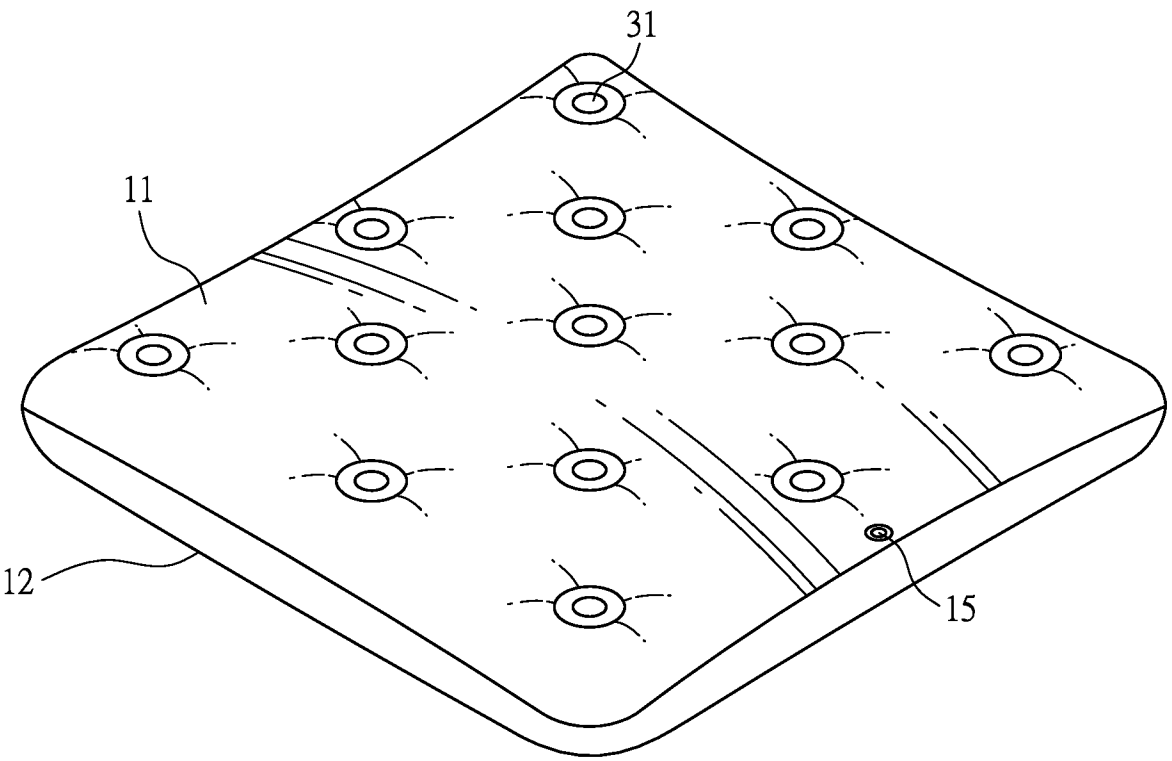
FIG. 4 is a perspective view showing an improved structure of an inflatable cushion according to a different embodiment of the present invention.

In addition, in another improved structure of an inflatable cushion, generally designated at 200 in FIG. 4, a difference from the previous improved structure of inflatable cushion structure 100 is that the improved structure of the inflatable cushion 200 does not include a side layer 13; however, the interior structure is similar to that illustrated in FIG. 2, where the improved structure of the inflatable cushion 200 comprises: a top layer 11, which constitutes a surface of the inflatable cushion; a bottom layer 12, which constitutes an undersurface of the inflatable cushion and in connected, circumferentially, to an outer circumference of the top layer 11 such that the inflatable cushion defines therein an interior space 14; a plurality of longitudinal stretch bands 21, which is arranged in the interior space 14 in such a way that portions of the longitudinal stretch bands 21 are jointed to the top layer 11 to form a plurality of first connection sections 31; and a plurality of lateral stretch bands 22, which is arranged in the interior space 14 in such a way that portions of the lateral stretch bands 22 are jointed to the bottom layer 12 to form a plurality of second connection sections 32, wherein the lateral stretch bands 22 and the longitudinal stretch bands 21 are arranged to overlap and intersect each other and the first connection sections 31 mounted to the top layer 11 and the second connection sections 32 mounted to the bottom layer 12 oppose each other in a vertical direction. One of the top layer 11 and the bottom layer 12 is provided with an air valve 15 for filling air into or releasing air from the interior space 14 for inflation or deflection.

Further, the portions of the longitudinal stretch bands 21 are jointed to the top layer 11 by means of ultrasonic fusion to form the first connection sections 31; and the portions of the lateral stretch bands 22 are jointed to the bottom layer 12 by means of ultrasonic fusion to form the second connection sections 32. In a practical example of manufacturing, the top layer 11, the bottom layer 12, and the side layer 13 can be made of polyvinyl chloride (PVC) or thermoplastic polyurethane (TPU) or other similar materials.

Figure 5:
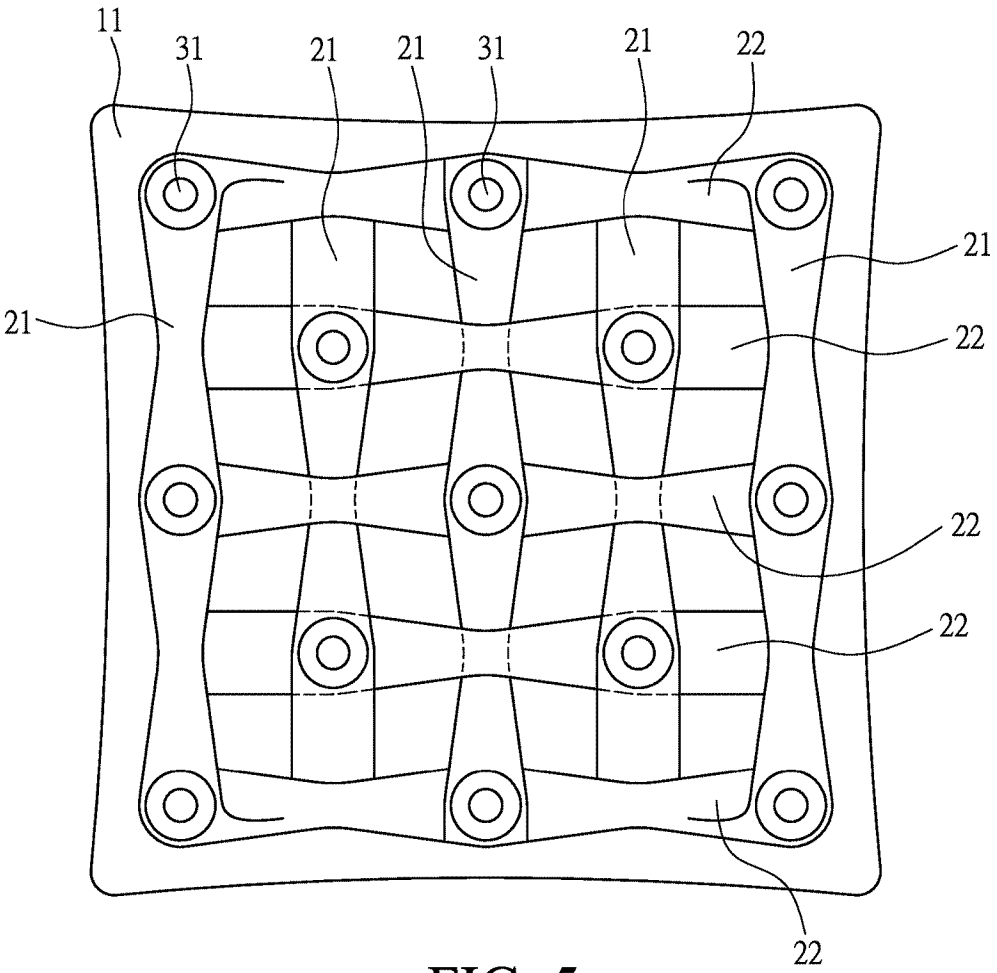
FIG. 5 is a plan view of an example of application of the improved structure of the inflatable cushion according to the present invention.
Figure 6:
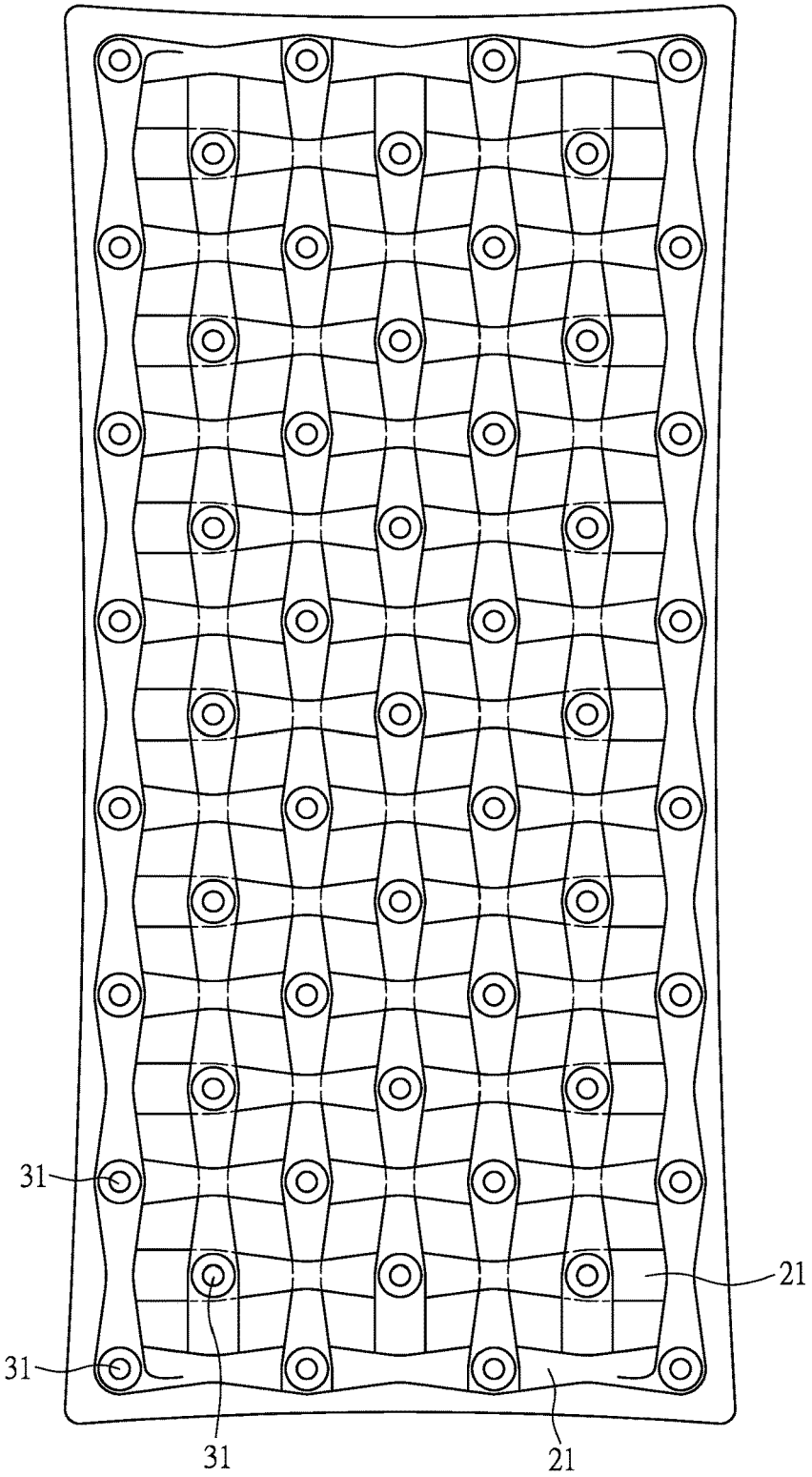
FIG. 6 is a plan view of another example of application of the improved structure of the inflatable cushion according to the present invention.

The improved structure of the inflatable cushion 100, 200 of the present invention can be made in the form of a seat cushion (as shown in FIG. 5), a bed mattress (as shown in FIG. 6) or a pillow cushion, but not limited these forms.

Thus, the present invention provides an improved structure of an inflatable cushion, which comprises an overlapping and intersecting arrangement of longitudinal stretch bands and lateral stretch bands structure mounted in an interior space of the cushion to help spread out and uniformly distribute tensile force or stretching force induced in first connection sections with which the bands are jointed to the top layer and second connection sections with which the bands are jointed to the bottom layer. The longitudinal stretch bands and the lateral stretch bands can be made of materials having better stretchability so that the potential risk that the first connection sections and the second connection sections are torn apart or broken or otherwise damaged due to stretching or pulling can be reduced.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An inflatable cushion, comprising:

a top layer, which constitutes a surface of the inflatable cushion;

a bottom layer, which constitutes an undersurface of the inflatable cushion;

a side layer, which is connected to circumferences of the top layer and the bottom layer to constitute a circumferential surface of the inflatable cushion such that the inflatable cushion defines therein an interior space;

a plurality of longitudinal stretch bands, which are arranged in the interior space in such a way that portions of the longitudinal stretch bands are jointed to the top layer to form a plurality of first connection sections;

a plurality of lateral stretch bands, which are arranged in the interior space in such a way that portions of the lateral stretch bands are jointed to the bottom layer to form a plurality of second connection sections, wherein the lateral stretch bands and the longitudinal stretch bands are arranged to overlap, intersect and wrap each other to form a plurality of overlapping intersecting wrapping sites in three dimensional space and the first connection sections mounted to the top layer and the second connection sections mounted to the bottom layer oppose each other in a vertical direction.

2. The inflatable cushion as claimed in claim 1, wherein the portions of the longitudinal stretch bands are jointed to the top layer by means of ultrasonic fusion to form the first connection sections and the portions of the lateral stretch bands are jointed to the bottom layer by means of ultrasonic fusion to form the second connection sections.

3. The inflatable cushion as claimed in claim 1, wherein the top layer, the bottom layer, and the side layer are made of polyvinyl chloride (PVC) or thermoplastic polyurethane (TPU).

4. The inflatable cushion as claimed in claim 2, wherein the top layer, the bottom layer, and the side layer are made of polyvinyl chloride (PVC) or thermoplastic polyurethane (TPU).

5. The inflatable cushion as claimed in claim 1, wherein one of the top layer, the bottom layer, and the side layer is provided with an air valve for inflation or deflation of the interior space.

6. The inflatable cushion as claimed in claim 2, wherein one of the top layer, the bottom layer, and the side layer is provided with an air valve for inflation or deflation of the interior space.

7. The inflatable cushion as claimed in claim 1, wherein the inflatable cushion is in the form of a seat cushion, a bed mattress, or a pillow cushion.

8. The inflatable cushion as claimed in claim 2, wherein the inflatable cushion is in the form of a seat cushion, a bed mattress, or a pillow cushion.

9. An inflatable cushion, comprising:

a top layer, which constitutes a surface of the inflatable cushion;

a bottom layer, which constitutes an undersurface of the inflatable cushion and is connected, circumferentially, to an outer circumference of the top layer such that the inflatable cushion defines therein an interior space;

a plurality of longitudinal stretch bands, which are arranged in the interior space in such a way that portions of the longitudinal stretch bands are jointed to the top layer to form a plurality of first connection sections; and a plurality of lateral stretch bands, which are arranged in the interior space in such a way that portions of the lateral stretch bands are jointed to the bottom layer to form a plurality of second connection sections, wherein the lateral stretch bands and the longitudinal stretch bands are arranged to overlap, intersect and wrap each other to form a plurality of overlapping intersecting wrapping sites in three dimensional space and the first connection sections mounted to the top layer and the second connection sections mounted to the bottom layer oppose each other in a vertical direction.

10. The inflatable cushion as claimed in claim 9, wherein the portions of the longitudinal stretch bands are jointed to the top layer by means of ultrasonic fusion to form the first connection sections and the portions of the lateral stretch bands are jointed to the bottom layer by means of ultrasonic fusion to form the second connection sections.

11. The inflatable cushion as claimed in claim 9, wherein the top layer and the bottom layer are made of polyvinyl chloride (PVC) or thermoplastic polyurethane (TPU).

12. The inflatable cushion as claimed in claim 10, wherein the top layer and the bottom layer are made of polyvinyl chloride (PVC) or thermoplastic polyurethane (TPU).

13. The inflatable cushion as claimed in claim 9, wherein one of the top layer and the bottom layer is provided with an air valve for inflation or deflation of the interior space.

14. The inflatable cushion as claimed in claim 10, wherein one of the top layer and the bottom layer is provided with an air valve for inflation or deflation of the interior space.

15. The inflatable cushion as claimed in claim 9, wherein the inflatable cushion is in the form of a seat cushion, a bed mattress, or a pillow cushion.

16. The inflatable cushion as claimed in claim 10, wherein the inflatable cushion is in the form of a seat cushion, a bed mattress, or a pillow cushion.

* * * * *